US005478025A

United States Patent [19]

Wang

[11] Patent Number: 5,478,025

[45] Date of Patent: Dec. 26, 1995

[54] TENSION CONTROLLED WINDING DEVICE

[76] Inventor: Shing Wang, No. 15, Chun An Street Shu Lin Jenn, Taipei Hsien, Taiwan

[21] Appl. No.: 287,909

[22] Filed: Aug. 9, 1994

[51] Int. Cl.[6] ..... B65H 23/195; B65H 18/10

[52] U.S. Cl. ..... 242/414.1; 242/530.3; 242/415.1

[58] Field of Search ..... 242/530.3, 413, 242/413.5, 413.8, 414.1, 415.1

[56] References Cited

U.S. PATENT DOCUMENTS

| | | | |
|---|---|---|---|
| 2,684,210 | 7/1954 | Conti | 242/530.3 |
| 2,779,548 | 1/1957 | Helmer | 242/414.1 X |
| 3,424,395 | 1/1969 | Schmidt et al. | 242/530.3 |
| 3,603,521 | 9/1971 | Ormsby | 242/413 |
| 4,063,692 | 12/1977 | Buggy | 242/415.1 X |
| 5,180,115 | 1/1993 | Stein | 242/530.3 |

*Primary Examiner*—John M. Jillions
*Attorney, Agent, or Firm*—Bacon & Thomas

[57] ABSTRACT

The present invention relates to a tape winding tension control device which has at least one electromagnetic tension controller, a control circuit and at least one central processor, in which, the electromagnetic tension controller and control circuit in conjunction with the tape winding shaft form a cylinder shaft shape. There is an external electrode located on the exterior of the electromagnetic tension controller, and an inner ring electrode within. One microprocessor is located in every control circuit to stimulate the inner ring electrode by means of an output current. This allows an electromagnetic field to be formed to produce the rotating movement of the winding shaft, for providing the movement of the tape paper base. The central processor thus separately commands the tension of each microprocessor.

4 Claims, 5 Drawing Sheets

TENSION CONTROLLED WINDING DEVICE

BACKGROUND OF THE INVENTION

The present invention relates to a tension controlled winding device, and in particular, a plastic tape winding mechanism which comprises several electromagnetic tension controlled units with matching electrical circuits placed between a winding shaft and a tape tube. A central processing unit separately controls all electric circuits and the tension between the winding shaft and the tape tube.

DESCRIPTION OF THE PRIOR ART

Plastic tape is one of the indispensable stationary items in our daily lives. Due to its taping and sealing capacity, the related products are too numerous to mention in quantity. Yet, closely related to the manufacturing of the product is the tape winding mechanism which may directly influence the quality of the tape.

The conventional tape winding shaft structures displayed in FIG. 6 and 7 are composed of a winding shaft with threads, a drive ring (A), and a spring (B) placed on the inner side of both ends; between two springs, several tube base (as the base for tape paper tube), (C) are located on the surface of the winding shaft. Desired tension is achieved through the adjustable springs (B) and drive rings (A). The difference between FIG. 6 and FIG. 7 is the tooth shaped plates on tube bases (C) to station the tape paper tubes; other than this, the surface tension between the tape paper tube and the tube base determining factors of both structures are:

1. The wall tightness between each tube base, which is closely related to the adjustment of drive ring (A); and,
2. the friction between the inner wall of each tube base and the tape winding shaft.

Due to the design nature of the conventional device, the existing hurdles are:

<1>. It is hard to control and to adjust the surface tension of the tape paper tube on the winding shaft. Due to the structure of the drive ring in fastening between the tube bases, it is necessary to stop the machine to make adjustment, which makes the adjustment quite awkward and troublesome. IN addition, it will take several tries to make it proper, instead of adjusting the tension while the machine is running. The consequence is uneven tension on the finished product.

<2>. The mechanical adjustment device is unreliable and lacks accuracy. The conventional device is controlled by mechanical components in order to make the tension adjustment. Because of the structure design being uniform, the individual role of each tape may not be adjusted separately. Often, due to human error or machine malfunction [like slip or drive ring (A)], the error will arise without warning. This will not only cause a hassle when adjusting the tension, but also will result in a quality control problem.

SUMMARY OF THE PRESENT-INVENTION

The purpose of the present invention is to offer a tension controlled tape winding model comprised of an electrically controlled tension unit with its matching electrical circuit to form a cylinder structure, separately united on the winding shaft. There is an external electrode on the outside of the electromagnetic controlled tension unit, with several station plates on the external electrode for installing tape paper tubes. For every electric control circuit, there is a microprocessor within to control each individual coil which allows the external electrode to control the surface tension by means of an electrical, electromagnetic approach to control and adjust its surface tension. This achieves the purpose of swift accurate tension adjustment without stopping the machine repeatedly.

Another purpose of the present invention is to provide a new winding tension control device, having a microprocessor in every electric control circuit which is monitored by the central processor, which individually operates each electromagnetic tension control unit in making adjustment to produce uniform product swiftly and accurately. The present invention uses an electric signal to adjust and control the surface tension, thus it may be operated at any given time while the machine is running. This will eliminate the mistakes and hassles that the conventional machine produces.

DETAILED DESCRIPTION OF THE INVENTION

Figure 1:
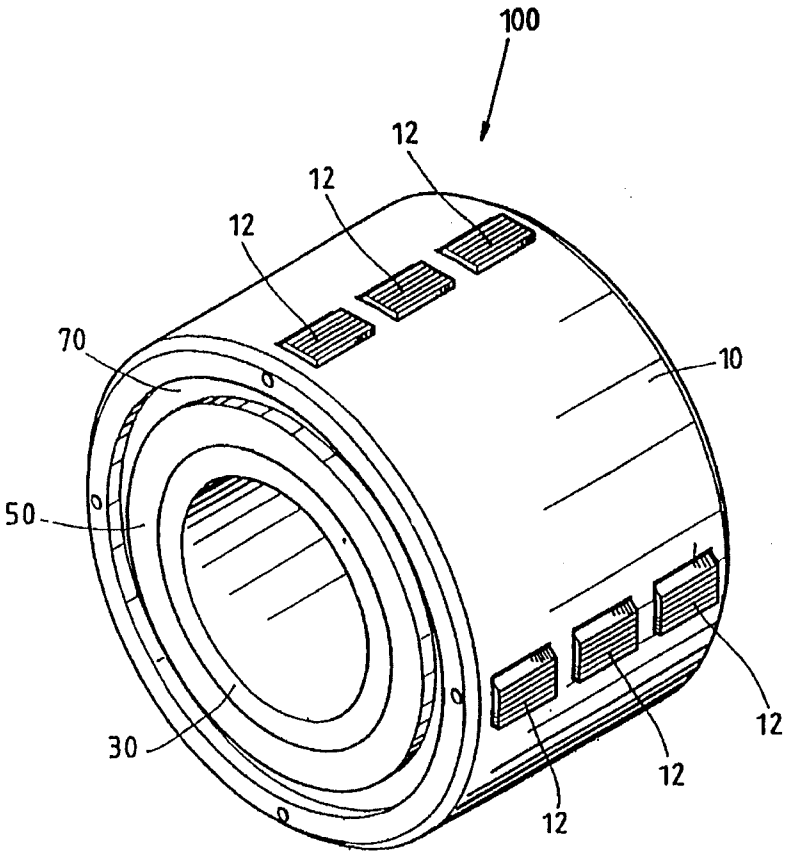
FIG. 1 is a perspective view of the electromagnetic tension control unit of the present invention.
Figure 3:
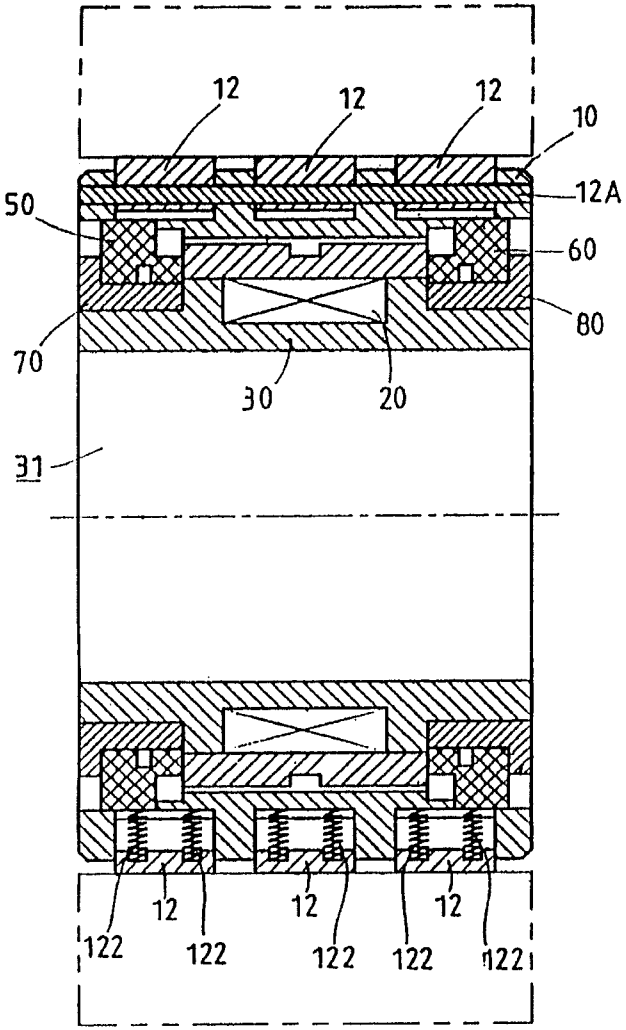
FIG. 3 is the side cross-sectional view of the electromagnetic tension control unit of FIG. 1.
Figure 2:
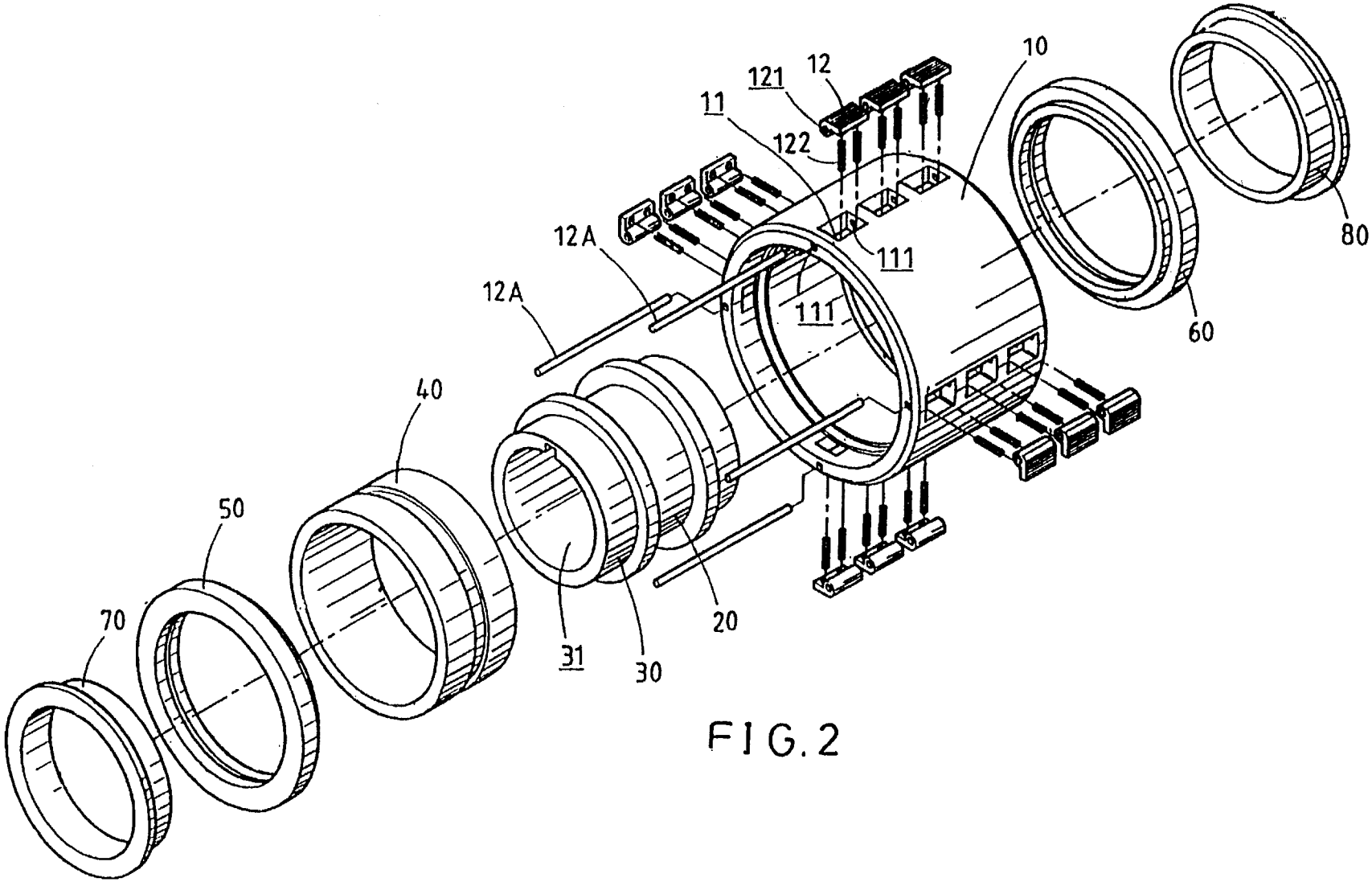
FIG. 2 is an exploded perspective view of the electromagnetic tension control unit of FIG. 1.

Refer to FIGS. 1 to 3, the winding tension controlled device of the present invention comprises an electromagnetic unit 100, a cylinder shaped external electrode 10 having the size of the tape as the exterior of the electromagnetic tension control unit 100, and several assembly holes 11 equidistantly spaced on the exterior of external electrode 10. On one side of the assembly holes 11 there is a penetrating aperture 111 to connect assembly holes 11. A series of fasten buckles 12 in the same numbers as the assembly holes, and connecting eyelets 121 are designed to connect each fasten buckle 12 and penetrating aperture 111, by a pin 12A to fasten the fasten buckles 12 into the assembly hole 11, with springs 122 placed within each assembly hole 11 to allow up and down motion for each fasten buckle 12.

A coil 20 is placed in the center of a cylinder shaped coil seat 30 and are located in the interior of the external electrode 10. A tape winding shaft matching sleeve 31 is formed by the coil seat 30 to allow the coil seat 30 assembly to be placed onto the tape winding shaft. On the outside, the opposite side to the coil 20, an inner ringed electrode 40 comprised of a magnetically conducting material is placed with an appropriate clearance (shown as FIG. 3), and on the two sides of the coil seat 30, slide rings 50, 60 and fastening sleeves 70, 80 are placed, to fasten the coil seat 30 into the interior of external electrode 10. The structure of electromagnetic tension control unit 100 of the present invention is thus completed.

Figure 4:
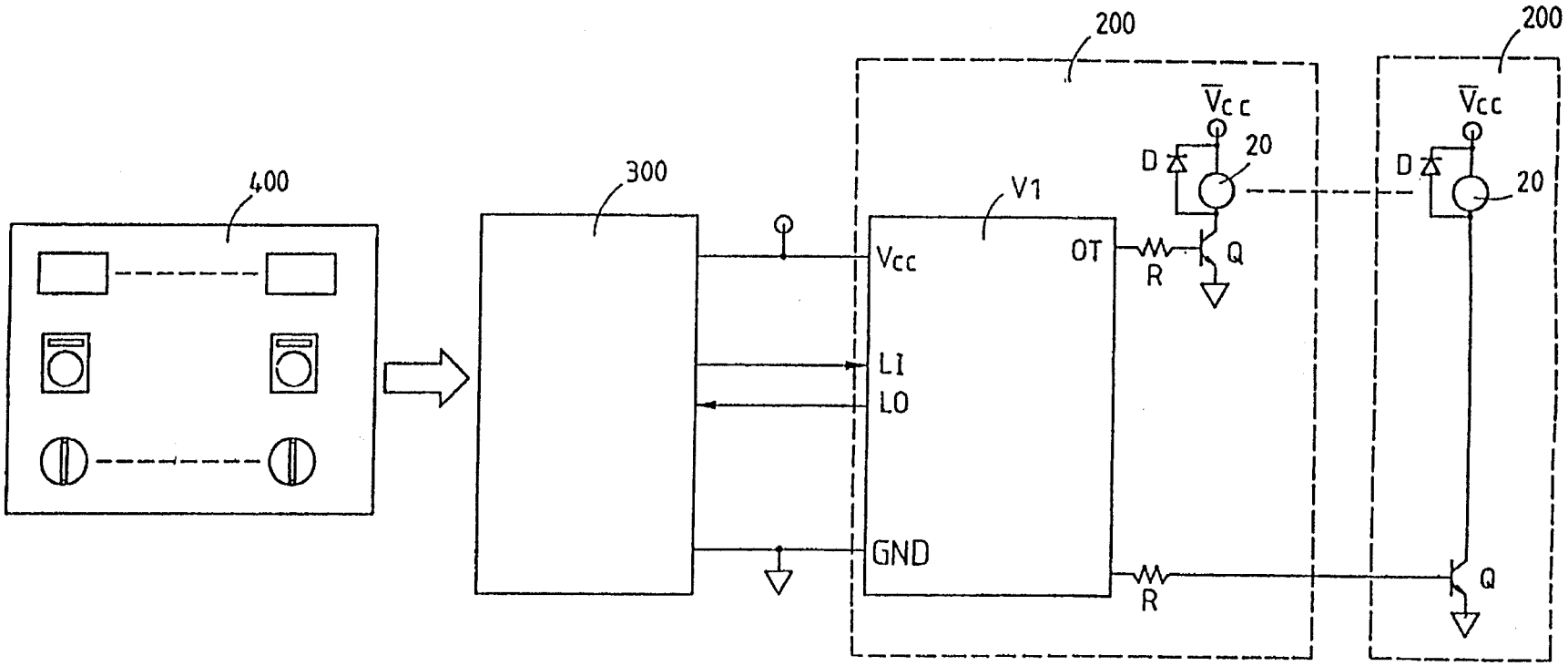
FIG. 4 is the electric schematic circuit diagram of the present invention.

Referring to FIG. 4, the winding tension controlled device of the present invention includes several control circuits 200 equal to the numbers of the electromagnetic tension controllers 100, at least one central processor unit 300 and an input device 400. The input device 400 is to offer current and exterior programmed signals (like signals input by key board) to the central processor, with multi-network control functions. Every control circuit 200 comprises at least one microprocessor VI and a VCC terminal and GND terminal to receive current from central processor 300, and is connected with signal lines L1 and L0 as its structure to allow the microprocessor VI in each control circuit 200 to connect with central processor 300. This will allow each microprocessor circuit 200 to be controlled by the central processor 300, and every microprocessor 200 is connected by output port OT with a drive network which is composed of a resistor R, transistor Q, and a diode D. The output port OT is connected to the base of transistor Q through a resistor R, the collector of the transistor Q is connected to the diode D and the two ends of the coil 20 within the electromagnetic tension controller 100 to drive every coil 20 in the electromagnetic tension controller 100 in control of the microprocessor within.

This constructs the system circuit of the winding tension device of the present invention.

Figure 5:
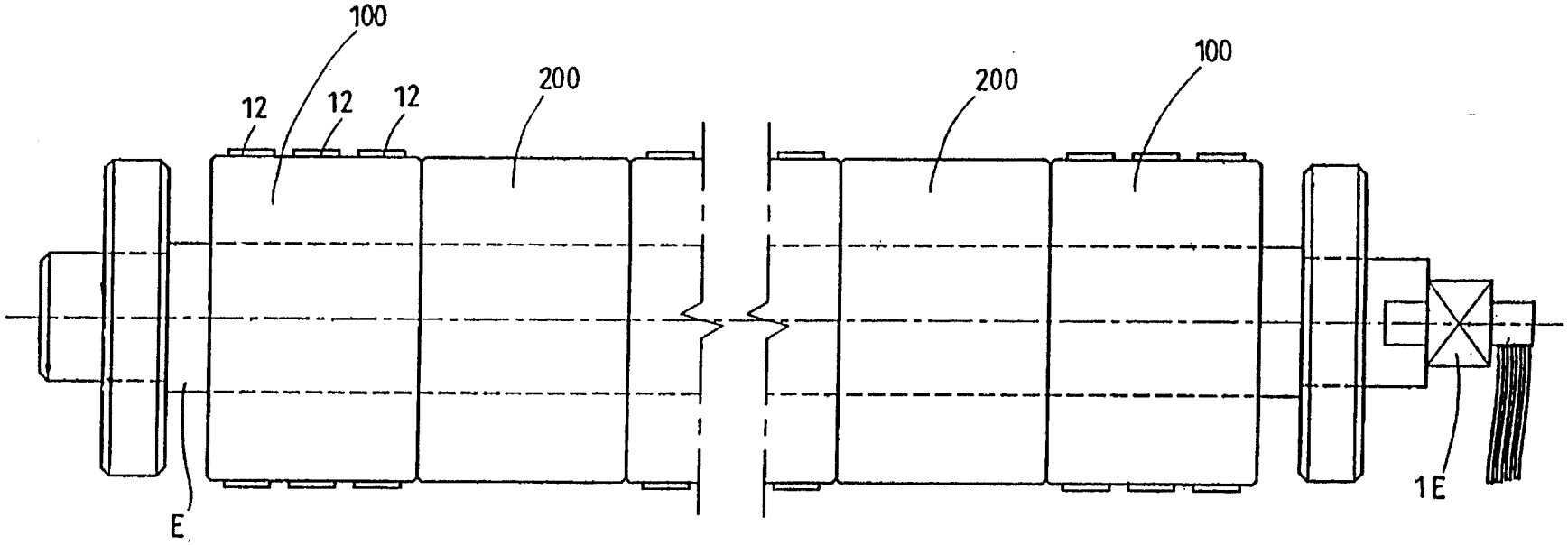
FIG. 5 is a front view of the present invention.
Figure 6:
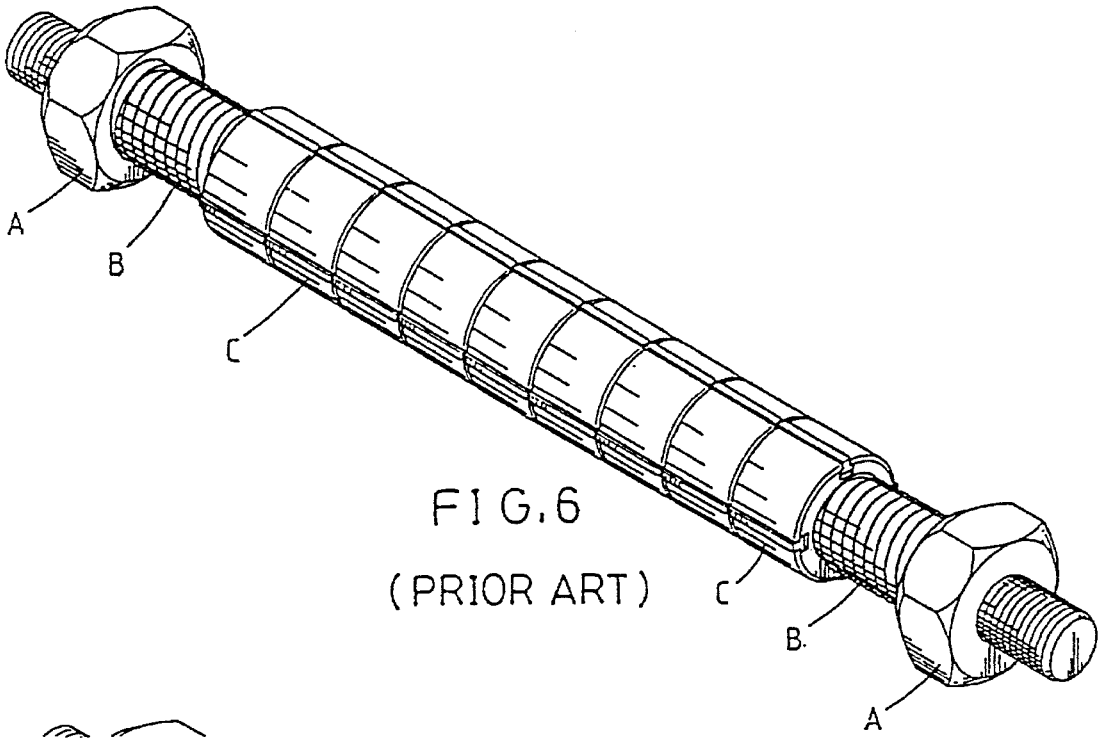
FIG.6 (PRIOR ART)
FIG. 6 is a perspective view of a conventional tape winding machine.
Figure 7:
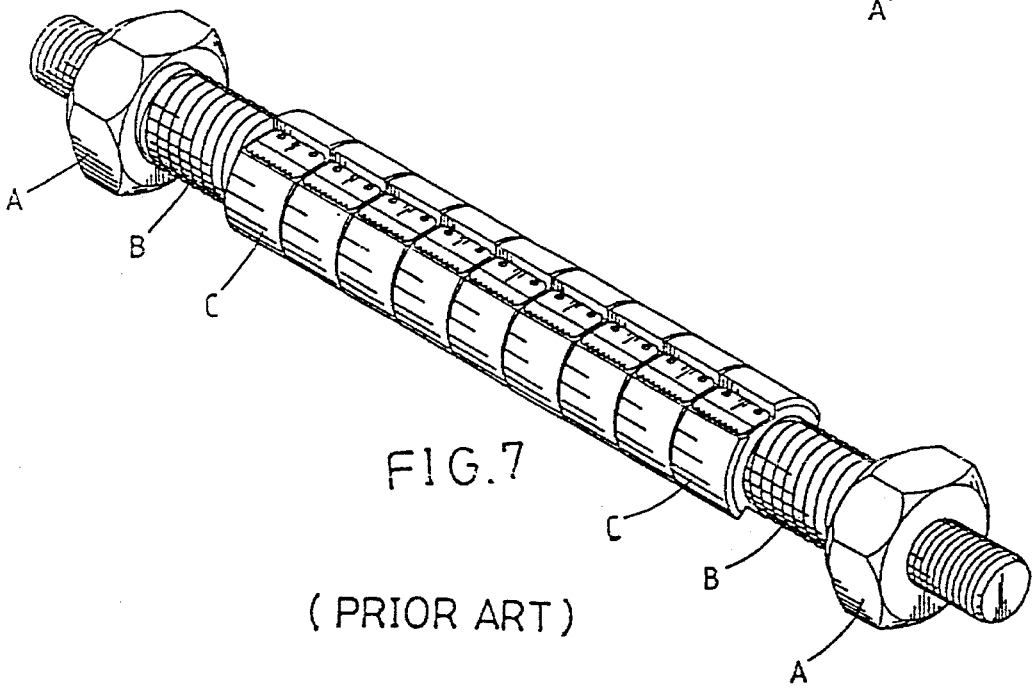
FIG.7 (PRIOR ART)
FIG. 7 is a perspective view of another conventional tape winding machine.

As shown in FIG. 5, every control circuit 200 connects to the winding shaft E, and in combination with the electromagnetic tension controller 100, the fasten buckle 12 on external electrode 10 will offer a stable base for the tape paper base onto the exterior. A mercury electric conductor in terminal 1E which resembles the adapter at the end of the winding shaft connects all current input wires of the control circuits 200 and to the central processor 300. This may also achieve output drive command to control microprocessor VI in control circuit 200 through central processor 300 according to command input by input device 400, and further allows each microprocessor 200 to have separate outputs different or similar to (depend on command) drive value to the coil 20 of each electromagnetic tension controller 200, to have each coil 20 produce the same or different electromagnetic field, and to influence the inner ring electrode 40 and external electrode 10 in rotating with the winding shaft E. At this time, the electromagnetic rotating pattern of tension adjusting motion between the paper base and winding shaft will occur.

In addition, the rotating electromagnetic tension adjustment principle is accomplished by the electromagnetic rotating ratio of the external electrode 210 to serve as the tension adjustment mechanism. The tape winding tension pressure on the paper base in the electromagnetic tension controller 100 is achieved swiftly and accurately, and further produces even quality tapes. At the same time, the present invention adapts the electrical signal to control, thus, the tension control may be adjusted while the machine is running, which is more convenient to control and adjust the tension for operators. Owing to the mistakes being eliminated, the present invention is more practical and further improves on the hassles of conventional devices.

To sum it all, the present invention is a creative model, specially as the tension controlled winding device within is indeed designed for easy operation and swift, accurate effect may be achieved.

I claim:

1. A tape winding tension control device having a rotatable tape winding shaft, and a cylinder structure comprising: a plurality of separate electromagnetic tension controllers to match the rotation of the tape winding shaft, each controller having a hollow cylinder shaped external electrode with a plurality of extendable and retractable fasten buckles; a sleeve coil seat located within the external electrode and configured to fit on the tape winding shaft; at least one coil located on the sleeve coil seat; an inner ring electrode located between the coil and the external electrode to produce a magnetic field, wherein a space is maintained between the inner ring electrode and the external electrode; at least one control circuit located on the tape winding shaft connected with electromagnetic tension controllers, the control circuit having at least one input current IC microprocessor connected to a matching electromagnetic tension controller's coil by an output port to allow each microprocessor to control its associated coil of the electromagnetic tension controller;

a central processor, controlling the IC, and separately connected to each microprocessor by a current wire and a signal wire, which gives an individual command to control the tension of the given coil depending on the tension input the coil in the electromagnetic tension controller receiving a command of current from the microprocessor to allow a magnetic field to be formed within the inner ring electrode, which produces an altered magnetic field thus allowing the winding shaft to rotate, and adjusting the surface tension to control the tape winding tension between a tape base on the external electrode and the winding shaft.

2. The tape winding tension control of claim 1 wherein the central processor of the winding tension control device has a power source and a command input.

3. The tape winding tension control of claim 1 wherein the output port of the microprocessor of the control circuit is driven through a drive network, and is connected to one coil end of the electromagnetic tension control device.

4. The tape winding tension control of claim 3 wherein the drive network of the winding tension control device comprises at least one transistor, a diode and a resistor, the base of the transistor connected to the output port of the microprocessor through the resistor, and the collector of the transistor connected to the network of the diode and the coil.

* * * * *